US007665712B2

(12) United States Patent
Stott

(10) Patent No.: US 7,665,712 B2
(45) Date of Patent: Feb. 23, 2010

(54) APPARATUS FOR PRE-CASTING CONCRETE STRUCTURES

(75) Inventor: Gale J. Stott, Salt Lake City, UT (US)

(73) Assignee: Intellectual Property Management, LLC, Salt Lake City, UT (US)

( * ) Notice: Subject to any disclaimer, the term of this patent is extended or adjusted under 35 U.S.C. 154(b) by 334 days.

(21) Appl. No.: 11/232,289

(22) Filed: Sep. 20, 2005

(65) Prior Publication Data

US 2006/0174569 A1 Aug. 10, 2006

Related U.S. Application Data

(60) Provisional application No. 60/622,855, filed on Oct. 27, 2004.

(51) Int. Cl.
*B28B 7/24* (2006.01)
*B28B 7/36* (2006.01)
*E04B 2/00* (2006.01)

(52) U.S. Cl. ..... 249/162; 249/85; 249/112; 249/119; 249/128; 249/160; 249/189

(58) Field of Classification Search ..... 249/85, 249/112–115, 134, 157, 165, 189, 216, 117, 249/119, 120, 125–130, 160–162, 169–171, 249/187.1, 191, 155, 158; 52/426, 436; 425/338

See application file for complete search history.

(56) References Cited

U.S. PATENT DOCUMENTS 1,247,107 A 11/1917 Graham
1,276,264 A * 8/1918 Porter et al. ..... 249/13
1,712,678 A * 5/1929 Redman ..... 249/16
1,754,087 A * 4/1930 Flam ..... 249/129
1,937,306 A * 11/1933 Barriball ..... 249/16
2,185,335 A * 1/1940 Fischer ..... 52/426
2,474,654 A * 6/1949 Carlson ..... 264/226
2,651,391 A * 9/1953 Havens ..... 52/11
2,981,997 A 5/1961 Painter
3,260,494 A 7/1966 Deiggaard
3,360,231 A * 12/1967 Van Hezik ..... 249/129
3,381,929 A * 5/1968 Bancker ..... 249/5
3,481,093 A * 12/1969 Davidson ..... 52/293.1
3,507,084 A * 4/1970 Jay et al. ..... 52/601
3,635,642 A 1/1972 Mueller (Continued)

FOREIGN PATENT DOCUMENTS

GB 2241192 A * 8/1991

(Continued)

*Primary Examiner*—Philip C Tucker
*Assistant Examiner*—Dimple N Bodawala
(74) *Attorney, Agent, or Firm*—Workman Nydegger

(57) ABSTRACT

An apparatus for producing one or more pre-cast concrete structures. The apparatus may include partitions that may be positioned in a side by side arrangement. The partitions may be moveable with respect to each other to facilitate installation of reinforcing material and removal of the concrete structures from the apparatus after the concrete has hardened. Cavities may be defined by the partitions for receiving concrete to form structures having panels with integral columns. The columns may include slots for receiving an adjacent panel such that adjacent concrete structures may be joined together to form a continuous wall. The partitions may also include interchangeable liners such that different textures or finishes may be applied to the concrete structures.

38 Claims, 10 Drawing Sheets

U.S. PATENT DOCUMENTS 3,731,902 A 5/1973 Shoemaker
3,743,232 A 7/1973 Vaughan
3,843,089 A 10/1974 Scholz et al.
3,948,009 A 4/1976 Bernhard
3,954,377 A 5/1976 Scholz et al.
4,037,816 A * 7/1977 Scott ..... 249/83
4,156,516 A 5/1979 Oliver
4,178,343 A 12/1979 Rojo, Jr.
4,181,286 A * 1/1980 Van Doren ..... 249/82
4,191,521 A * 3/1980 Muldery et al. ..... 425/432
4,241,554 A 12/1980 Infantino
4,286,934 A 9/1981 Linetsky
4,290,246 A 9/1981 Hilsey
4,516,372 A * 5/1985 Grutsch ..... 52/309.12
4,579,312 A 4/1986 White
4,614,325 A 9/1986 Muldery et al.
4,669,240 A 6/1987 Amormino
4,694,624 A 9/1987 Juhas
4,769,191 A 9/1988 Diana
4,862,660 A * 9/1989 Raymond ..... 52/220.2
5,028,368 A 7/1991 Grau
5,065,561 A * 11/1991 Mason ..... 52/309.12
5,098,059 A * 3/1992 Sawyer ..... 249/16
5,154,837 A 10/1992 Jones
5,202,132 A 4/1993 Myers et al.
5,274,971 A 1/1994 Elmore et al.
5,404,685 A 4/1995 Collins
5,459,970 A 10/1995 Kim
5,486,391 A * 1/1996 Tyner ..... 428/44
5,509,249 A 4/1996 House et al.
5,524,405 A 6/1996 Byrd
5,588,786 A 12/1996 House et al.
5,689,927 A 11/1997 Knight, Sr.
5,728,312 A 3/1998 Van Doren
5,833,873 A * 11/1998 Adonetti ..... 249/47
5,845,448 A * 12/1998 Potvin ..... 52/563
5,860,262 A * 1/1999 Johnson ..... 52/426
5,881,524 A * 3/1999 Ellison, Jr. ..... 52/565
5,887,404 A 3/1999 Kreizinger
5,922,236 A * 7/1999 Zuhl ..... 249/34
5,930,970 A * 8/1999 De Le fevre ..... 52/630
6,000,182 A 12/1999 Keenan
6,003,278 A 12/1999 Weaver et al.
6,021,994 A 2/2000 Shartzer, Jr.
6,199,832 B1 3/2001 Morrow
6,264,867 B1 7/2001 Keenan
6,283,439 B1 * 9/2001 Myers et al. ..... 249/45
6,301,851 B1 10/2001 Matsubara
6,385,933 B1 5/2002 Owens
6,510,667 B1 * 1/2003 Cottier et al. ..... 52/742.14
6,550,215 B1 * 4/2003 Pulte et al. ..... 52/781.5
6,550,834 B2 4/2003 Fromelius
6,568,141 B2 * 5/2003 Kremers ..... 52/426
6,594,963 B1 * 7/2003 Bennett ..... 52/293.1
6,622,452 B2 * 9/2003 Alvaro ..... 52/742.14
6,631,599 B1 10/2003 Takagi
6,712,598 B2 3/2004 Jensen
6,811,357 B1 11/2004 Haug
6,848,232 B2 2/2005 Pulte et al.
6,898,912 B2 * 5/2005 Bravinski ..... 52/426
6,939,121 B2 9/2005 Giri et al.
7,073,767 B1 * 7/2006 Bennett ..... 249/120
7,146,775 B2 12/2006 Burkett
7,165,916 B2 1/2007 Nanayakkara
7,254,925 B2 * 8/2007 Stefanutti et al. ..... 52/309.9
2002/0000506 A1 1/2002 Khoo
2003/0163963 A1 9/2003 Pulte et al.
2003/0182889 A1 10/2003 Takagi
2003/0192272 A1 10/2003 Bravinski
2004/0104333 A1 * 6/2004 Ward et al. ..... 249/189
2004/0154246 A1 8/2004 DeSutter
2004/0217254 A1 * 11/2004 Myers et al. ..... 249/33
2005/0029429 A1 * 2/2005 Schworer ..... 249/42
2006/0174569 A1 8/2006 Stott
2007/0062142 A1 3/2007 Stott

FOREIGN PATENT DOCUMENTS

WO WO 0062987 10/2000

* cited by examiner

APPARATUS FOR PRE-CASTING CONCRETE STRUCTURES

CROSS-REFERENCE TO RELATED APPLICATIONS

This application claims the benefit of U.S. Provisional Application No. 60/622,855, filed Oct. 27, 2004, which is hereby incorporated by reference herein in its entirety, including but not limited to those portions that specifically appear hereinafter, the incorporation by reference being made with the following exception: In the event that any portion of the above-referenced provisional application is inconsistent with this application, this application supercedes said above-referenced provisional application.

STATEMENT REGARDING FEDERALLY SPONSORED RESEARCH OR DEVELOPMENT

Not Applicable.

BACKGROUND

1. The Field of the Invention

The present disclosure relates generally to devices for forming structures, and more particularly, but not necessarily entirely, to devices for forming precast concrete structures.

2. Description of Related Art

Precast concrete structures have been used in the building construction industry for many years. Precast concrete structures may include steel reinforced panels for use in constructing fences, walls, sound barriers and the like. High quality precast concrete structures may be formed efficiently since they may be constructed in a factory with specialized equipment, strict quality standards and controlled conditions not subject to rain, hot or cold temperatures, or builder errors. Moreover, labor savings may be accomplished since precast structures may be formed more efficiently in a factory than constructing a form on site to manufacture the structures in place. Use of precast concrete structures may also reduce construction delays associated with rain or inclement weather since concrete may not be properly poured on site in inclement weather.

In recent years, the use of precast concrete panels with decorative patterns formed on the exterior surface has increased in popularity. The precast concrete panels may have various different patterns such as stone or brick, for example. Such precast concrete panels may be easier to construct than stone or brick walls. Moreover, the precast concrete panels may be durable and provide advantages in that cracking may be reduced as compared to walls formed with grouted natural stone or brick, and no mortar joints are created with precast concrete panels to allow water to seep into the wall.

Various different types of devices are known in the art for forming precast concrete structures. Despite the advantages of known devices for forming concrete structures, improvements are still being sought to improve the efficiency of the manufacturing process and the quality of the concrete structures. Also, improvements are being sought for concrete structures to facilitate installation of the structures at the construction site.

The prior art is thus characterized by several disadvantages that are addressed by the present disclosure. The present disclosure minimizes, and in some aspects eliminates, the above-mentioned failures, and other problems, by utilizing the methods and structural features described herein.

The features and advantages of the disclosure will be set forth in the description which follows, and in part will be apparent from the description, or may be learned by the practice of the disclosure without undue experimentation. The features and advantages of the disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
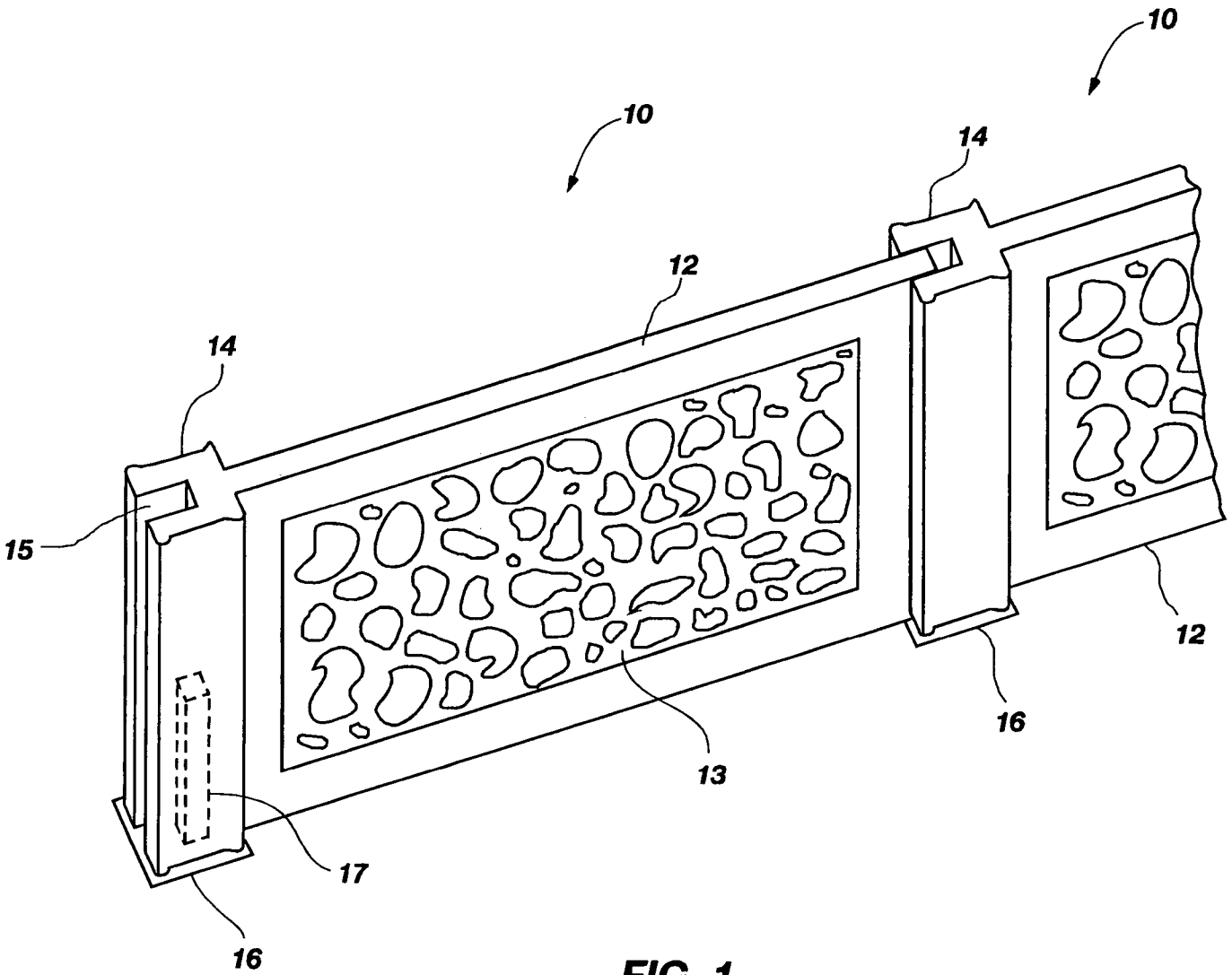
FIG. 1 is a perspective break-away view of one embodiment of structures made in accordance with the principles of the present disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

Before the present apparatus and method for forming one or more concrete structures is disclosed and described, it is to be understood that this disclosure is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the present disclosure will be limited only by the appended claims and equivalents thereof.

It must be noted that, as used in this specification and the appended claims, the singular forms "a," "an," and "the" include plural referents unless the context clearly dictates otherwise. Similarly, as used herein, the terms "comprising," "including," "containing," "characterized by," and grammatical equivalents thereof are inclusive or open-ended terms that do not exclude additional, unrecited elements or method steps.

As used herein, the term "concrete" shall be construed broadly to include conglomerate construction materials, including construction materials formed of aggregate and cementitious materials, as well as any other known material that may be placed in a fluid or semi-fluid form and hardened or solidified.

As used herein, the phrase "surface treatment" shall be construed broadly to include any variety of textures or designs or features that may be placed on the exterior of a concrete structure.

Referring now to FIG. 1, a break-away perspective view is shown of a plurality of structures, each structure indicated generally at 10. Each structure 10 may be formed of reinforced concrete, and may include a panel portion 12, for forming a wall, such as a fence or sound barrier, for example. The structure 10 may also form part of a retaining wall, building, or any other such construct. The panel portion 12 may include a surface treatment 13 or decorative pattern, such as stone or brick, for example, formed on an exterior surface.

The structure 10 may also include a column portion 14 for supporting the panel portion 12. The column portion 14 may have an increased lateral dimension as compared to the panel portion to allow increased vertical and lateral support of loads as the loads are transferred to a footing, floor, or other support member. The column portion 14 may also include a slot 15 for receiving a panel portion 12 of an adjacent structure 10. Accordingly, a plurality of structures 10 may be joined together to form a wall of a desired length and configuration.

In one embodiment of the present disclosure, the structure 10 may be supported on footings 16. The footings 16 may be formed in any manner known to those skilled in the art, such as cast in place reinforced concrete. A rigid member 17, shown in dashed lines in FIG. 1, such as an "I" beam, post, or rod, for example, may be fixed into the footing 16. It will be understood that some embodiments of the present disclosure may include a rigid member 17 embedded into the footing 16, or other embodiments may include rigid members 17 attached to the footing 16 by welding, bolts, or any other suitable method known to those skilled in the art. The rigid member 17 may be received in the slot 15 of the column portions 14 to support the structure 10 in an upright position. Some embodiments may also include the placement of concrete within the slot 15 of the column portions 14 to provide additional support to the structure 10.

Other embodiments of the structure 10 may include plates (not shown) attached to the footings 16 and the column portions 14 such that the plates may be attached together to support the structure 10 in an upright position. It will be understood that the plates may be imbedded into the footings 16 and column portions 14, or the plates may be attached to the footings 16 and column portions 14 using any other attachment method known in the art. Moreover, the plates on the footings 16 and column portions 14 may be attached together by welding, bolting, or any other attachment mechanism known to those skilled in the art. Similarly, any other suitable installation technique or device may be used to install the structure 10 within the scope of the present disclosure.

It will be understood that some embodiments of the structure 10 of the present disclosure may not include the column portions 14. Other embodiments of the structure 10 may not include the slots 15 within the column portions 14. Yet other embodiments of the structure 10 may include column portions 14 having upward extending openings in an interior of the column portions 14, such that the openings may be surrounded by concrete. Moreover, the structure 10 may be formed in various different cross-sectional shapes. Accordingly it will be understood that the structure 10 may have various different configurations within the scope of the present disclosure, and various different attachment mechanisms and methods may be utilized to install the structure 10.

Figure 2:
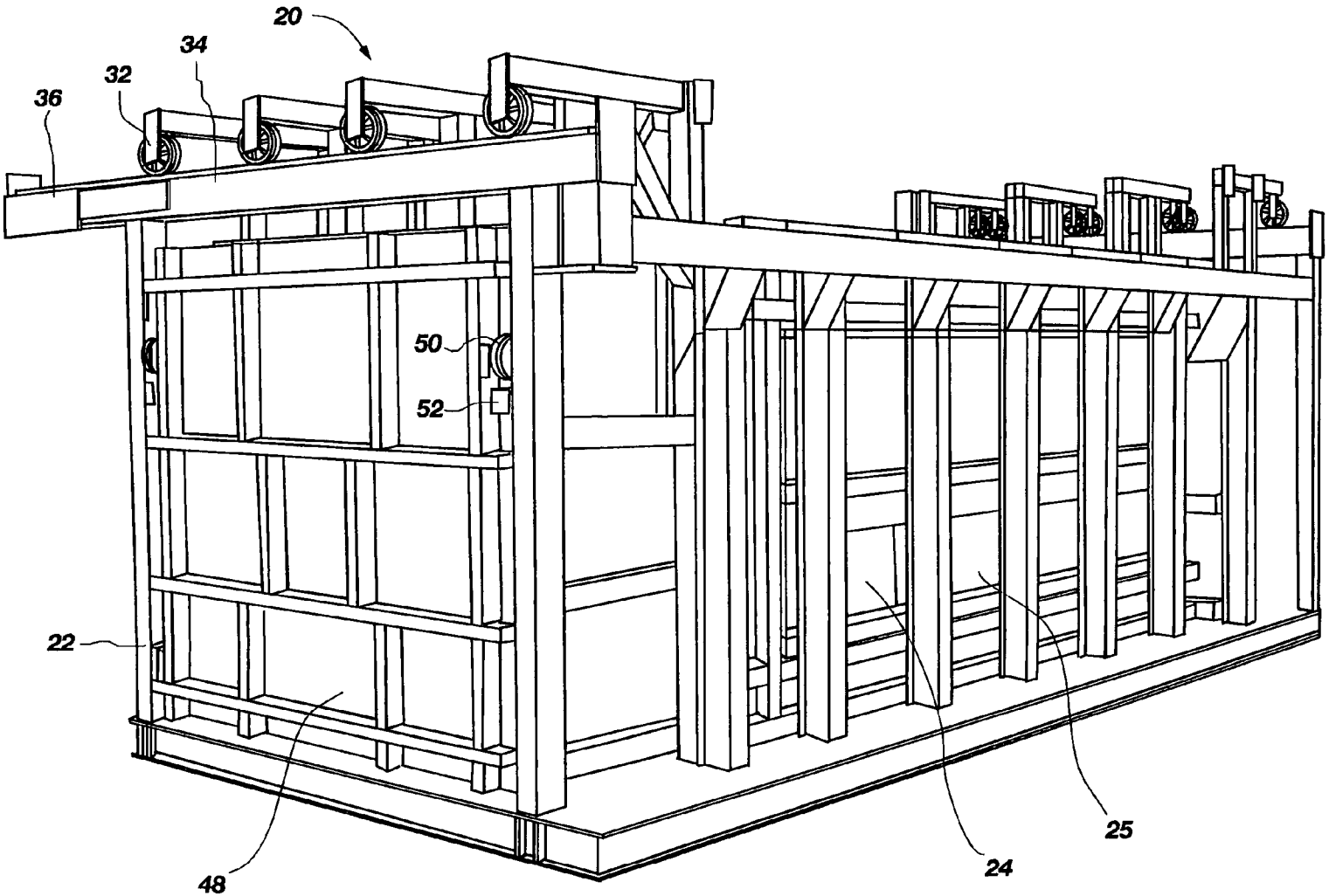
FIG. 2 is a perspective view of one embodiment of an apparatus for making the structures of FIG. 1 in accordance with the principles of the present disclosure.

Referring now to FIG. 2, a perspective view is shown of one embodiment of an apparatus, indicated generally at 20, for forming structures 10 in accordance with the principles of the present disclosure. The apparatus 20 may include a frame 22 and a base 23 for supporting a plurality of partitions 24. The frame 22 may be formed of an arrangement of columns, beams and/or braces configured to support the partitions 24 and the structures 10 formed by the apparatus 20. The base 23 may form a foundation for the apparatus 20 such that the apparatus 20 may be placed on the ground or any variety of floor surfaces.

Figure 3:
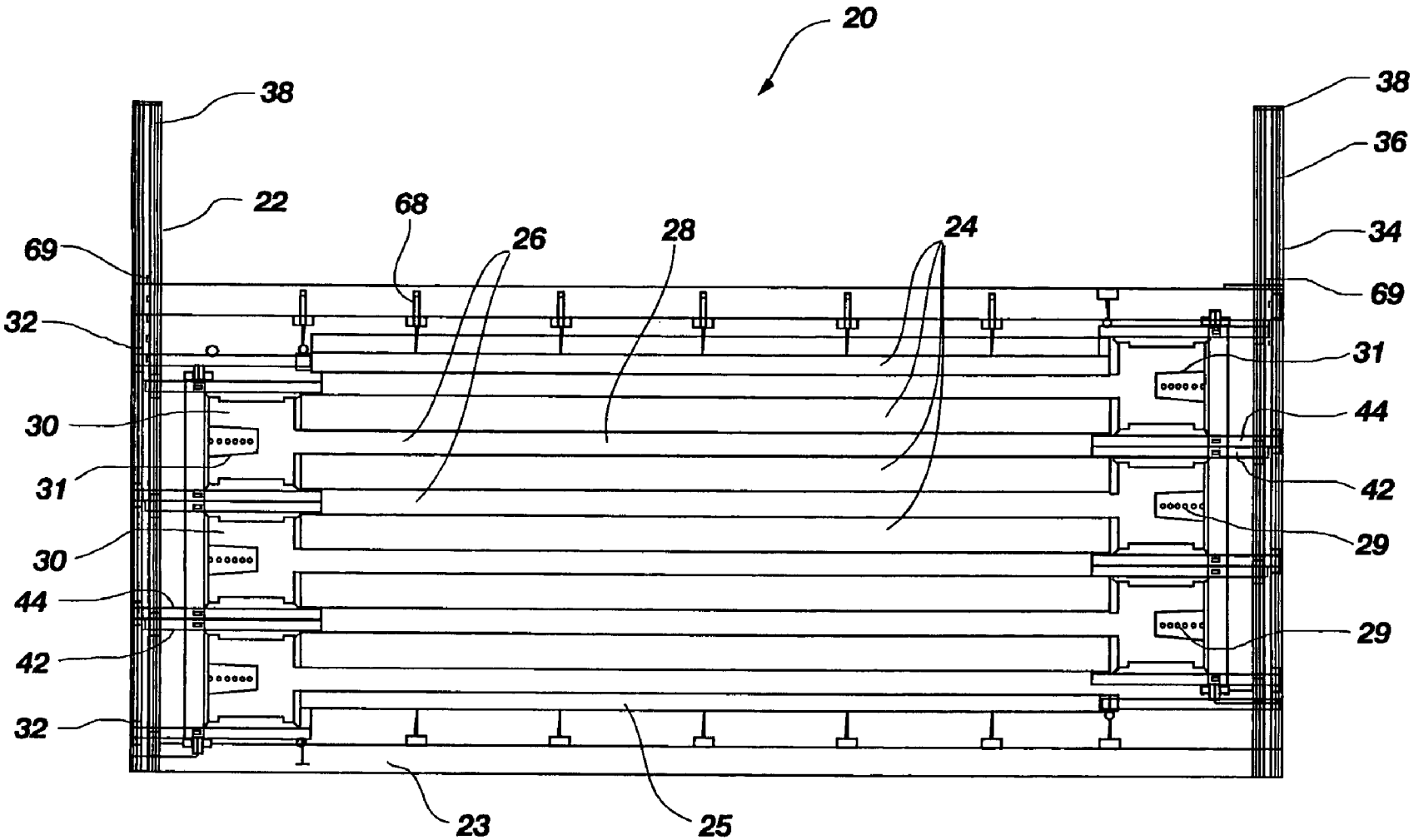
FIG. 3 is a top view of the apparatus of FIG. 2.

As best shown in FIG. 3, which shows a top view of the apparatus 20, the partitions 24 may define one or more cavities 26 for receiving concrete to form the structures 10. One embodiment of the partitions 24 may be configured to form a cavity 26 having a first portion 28 configured for forming the panel portion 12 of the structure 10, and a second portion 30 configured for forming the column portion 14 of the structure 10. The first portion 28 of the cavity 26 may be contiguous with the second portion 30 of the cavity 26 such that the structure 10 may be formed with the panel portion 12 and the column portion 14 integrally joined as a single piece member. The second portion 30 of the cavity 26 for forming the column portion 14 of the structure 10 may be formed having a wider dimension than the first portion 28 of the cavity 26 for forming the panel portion 12 of the structure 10. Accordingly, a column portion 14 of the structure 10 may be formed to withstand increased loads transferred from the panel portion 12 to the footing 16 or other such support member.

In one embodiment of the present disclosure, the partitions 24 may be arranged such that the second portions 30 of the cavities 26 for forming the column portion 14 of the structures 10 may be arranged on opposing ends of the apparatus 20 on adjacent partitions 24. For example, the apparatus may be configured to form six structures 10 at a time, and three of the column portions 14 of the structures 10 may be formed on one end of the apparatus 20, and the other three column portions 14 may be formed at the opposite end of the apparatus 20, with each adjacent structure 10 being formed with the column portions 14 on opposite ends of the apparatus 20. It will be understood, however, that the apparatus 20 may be configured to form various different quantities of structures 10 at a time, and that the partitions 24 may be configured in various different arrangements.

One or more ribs 31 may be positioned in the second portion 30 of the cavity 26 for forming the slot 15 in the column portion 14 of the structure. The ribs 31 may be sized and shaped corresponding to the desired size and shape of the slot 15 in the column portion 14 of the structure. The ribs 31 may be positioned at any desired location such that the concrete structures 10 may be formed as desired. For example, the rib 31 may be placed to form the slot 15 in the end of the concrete structures 10, such that the panel portion 12 of a concrete structure 10 may be received in the slot 15 of an adjacent concrete structure 10 to form a substantially straight barrier. Also, the rib 31 may be placed in a side of the end of the partition 24 such that the slot 15 may extend substantially perpendicular to the panel portion 12 to allow adjacent concrete structures 10 to form a corner. It will be understood that the ribs 31 may be positioned at any desired angle or location within the scope of the present disclosure. Moreover, some embodiments of the apparatus 20 may include one or more ribs 31 positioned in other parts of the cavity 26 to form slots in the panel portion 12 of the structure 10, or to form openings within an interior of the column portion 14.

One embodiment of the present disclosure may include ribs 31 that may be removably attached using bolts, indicated by dashed lines at 29, such that the ribs 31 may be removed and repositioned as desired. It will be understood that other embodiments of the present disclosure may include other types of attachment mechanisms for the ribs 31, and some embodiments of the present disclosure may include ribs that may be fixed in place. Other embodiments may not include any ribs such that the structures may be formed without slots 15.

Figure 4:
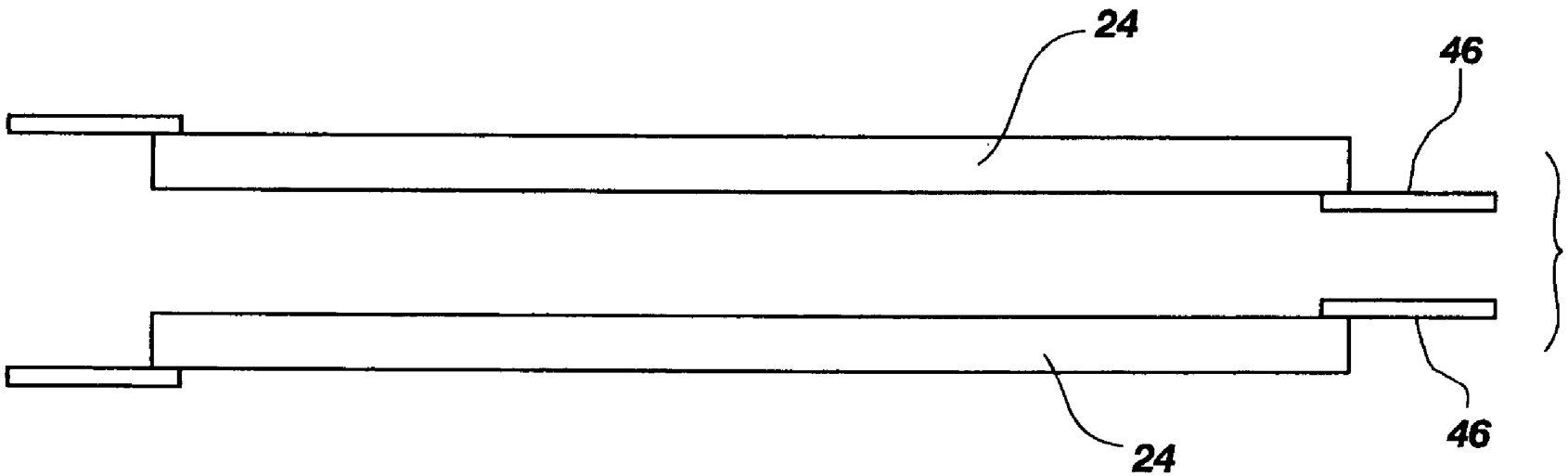
FIG. 4 is an exploded top view of adjacent partitions of the apparatus of FIG. 2.

The partitions 24 may be positioned in a side by side arrangement and at least some of the partitions 24 may be configured to be movable with respect to the frame 22 to facilitate placing reinforcing steel into the cavity 26 as well as to facilitate removing the structure 10 after the concrete has hardened. FIG. 4 shows an exploded top view of adjacent partitions 24. It will be appreciated that the partitions 24 may be separated such that reinforcing steel may be placed between the partitions 24. The partitions 24 may be joined together such that end panels 46 on adjacent partitions 24 come into contact with each other. Accordingly the cavity 26 may thereby be defined by the partitions for receiving concrete for forming the structure 10. Once the concrete has hardened, the partitions 24 may be separated for removing the structure 10. One embodiment of the apparatus 20 may include wheels 32 for supporting the partitions 24 on the frame 22 and allowing the partitions 24 to be easily moved.

In one embodiment of the apparatus 20, the frame 22 may include a support 34 for receiving the wheels 32. The support 34 may extend laterally to provide a space to allow the partitions 24 to be moved apart from each other. An overhang portion 36 of the support 34 may be detachable such that the width of the apparatus 20 may be reduced to facilitate transporting the apparatus 20. Any attachment mechanism known in the art, such as bolts, pins, or clamps, for example, may be used to attach the overhang portion 36 to the remainder of the support 34. Accordingly, the apparatus may be sized to fit on a trailer, rail car or other such transporting device to be transported on rails or highways. It will be understood that other embodiments of the apparatus 20 may include a one piece support 34 that may not be configured to be detached or otherwise retracted to a compact configuration.

Figure 14:
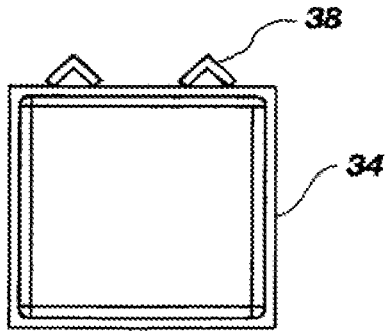
FIG. 14 is an end view of a support on the apparatus of FIG. 2.

One embodiment of the support 34 may include tracks 38 for assisting in maintaining the wheels 32 in position. An end view of the support 34 showing one embodiment of the tracks 38 is shown in FIG. 14. The tracks 38 may form ridges for guiding the wheels 32 along a specified path on the support 34. It will be understood that the tracks 38 may be formed in any suitable configuration and manner, and that some embodiments of the present disclosure may not include tracks.

The wheels 32 may be joined to the partitions 24 through arms 40. Adjacent arms 40 may have different lengths, such as a short arm 42 and a long arm 44, such that adjacent partitions 24 may be configured to abut each other without interference from the wheels 32. The arms 40 having different lengths allow the wheels 32 to extend at different locations along the support 34 without contacting each other to thereby allow the partitions 24 to be positioned in an abutting arrangement.

One embodiment of the apparatus 20 may include one or more partitions 24 that may be fixed in place. For example, an end partition 25 on an external side of the apparatus 20 may be attached to the frame 22 so as to be stationary. Other embodiments of the apparatus 20 may include partitions 24 that may all be moveable.

Figure 5:
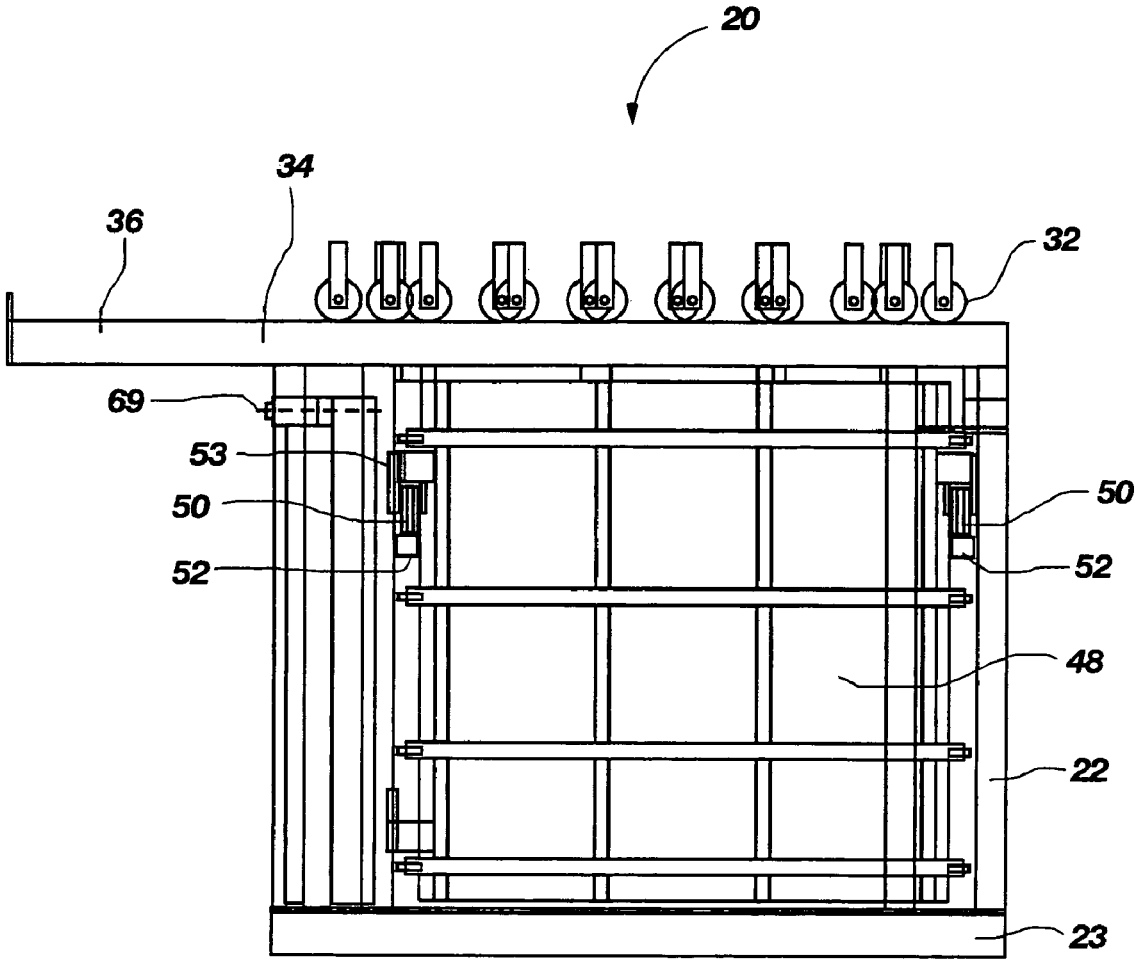
FIG. 5 is an end view of the apparatus of FIG. 2.
Figure 6:
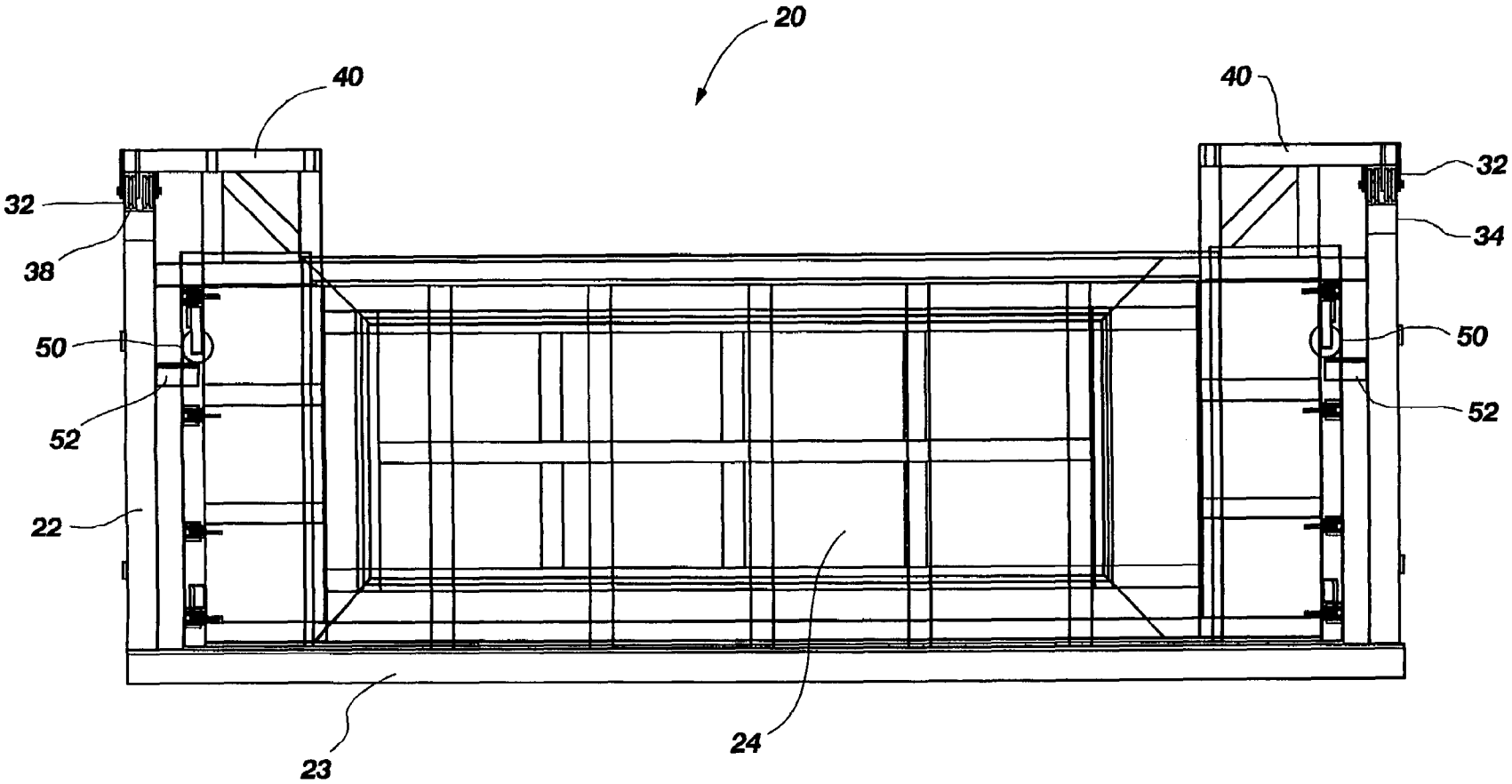
FIG. 6 is a side view of the apparatus of FIG. 2.

Referring to FIG. 5, an end view of the apparatus 20 is shown. The apparatus 20 may include an end wall or door 48 for enclosing an end of the partitions 24. It will be understood that a door 48 may be positioned on opposing ends of the apparatus 20. Alternatively, it will be understood that the door 48 may be positioned on a single end of the apparatus 20. The door 48 may be supported on door wheels 50 on opposing sides such that the door 48 may be capable of moving in a longitudinal direction of the apparatus away from the partitions 24 in a direction substantially perpendicular to the direction of movement of the partitions 24. As shown most clearly in FIG. 6, which shows a side view of the apparatus 20, the door wheels 50 may be supported on door supports 52 positioned on opposing sides of the apparatus 20 for providing a support surface for the door wheels 50 to roll upon. Accordingly, one embodiment of the present disclosure may provide a door 48 that can be moved in a translational manner for at least a part of its movement path. In other words, every point on the door 48 may move parallel to and the same distance as every other point on the door 48. Similarly, it will be understood that one or more of the partitions 24 may be configured to move in a translational manner, and the direction of movement of the partitions 24 may be substantially perpendicular to the movement of the door 48.

A hinge 53 may also be provided for the door 48 such that when the door 48 is moved a distance away from the partitions 24 into alignment with the hinge 53, the hinge 53 may be engaged to allow the door 48 to swing open. One embodiment of the hinge 53 may include a receiver on the door 48 and the frame 22 for receiving a pin, such that when the door 48 is moved to the point where the receivers are-in alignment, a pin may be placed in the receivers to join the door 48 with the frame 22 through the hinge 53, such that the door 48 may swing with respect to the frame 22. It will be understood that other embodiments of the door 48 may be attached by a hinge such that the door may be configured to swing without rolling a distance away from the partitions 24. Yet another embodiment of the apparatus 20 may be provided without a hinge.

In one embodiment of the present disclosure, allowing the door 48 to move away from the partitions 24 before swinging open may allow the ribs 31 to clear the slots 15 in the column portions 14 of the structures 10. Otherwise, swinging motion of the door 48 may be impeded by contact between the ribs 31 and slots 15 to make opening the door 48 difficult in some arrangements of the ribs 31.

Figure 8:
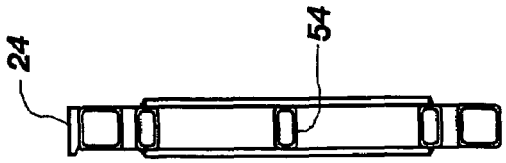
FIG. 8 is a cross-sectional view of the partition of FIG. 7 taken along line A-A.
Figure 7:
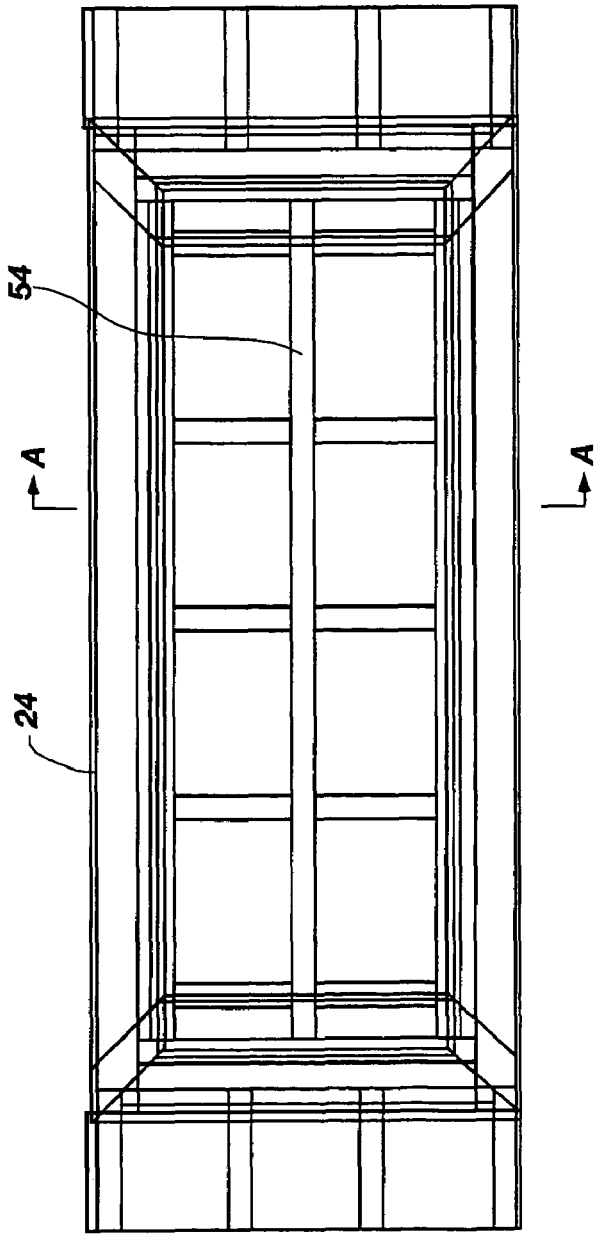
FIG. 7 is a side view of a partition as shown in FIGS. 3 and 4.

Referring now to FIG. 7, a side view of one embodiment of a partition 24 is shown. A cross-sectional view of the partition 24 taken along line A-A is shown in FIG. 8. It will be understood that the partition 24 may be sized to form a structure 10 and the partition 24 may include one or more brace members 54. The brace members 54 may be sized and positioned to provide strength to the partition 24 since the forces exerted by concrete in the apparatus 20 may be significant. It will be understood that some of the brace members 54 may be positioned in an upright orientation, and that other embodiments of the brace member 54 may be positioned in a lateral or diagonal orientation.

Figure 9:
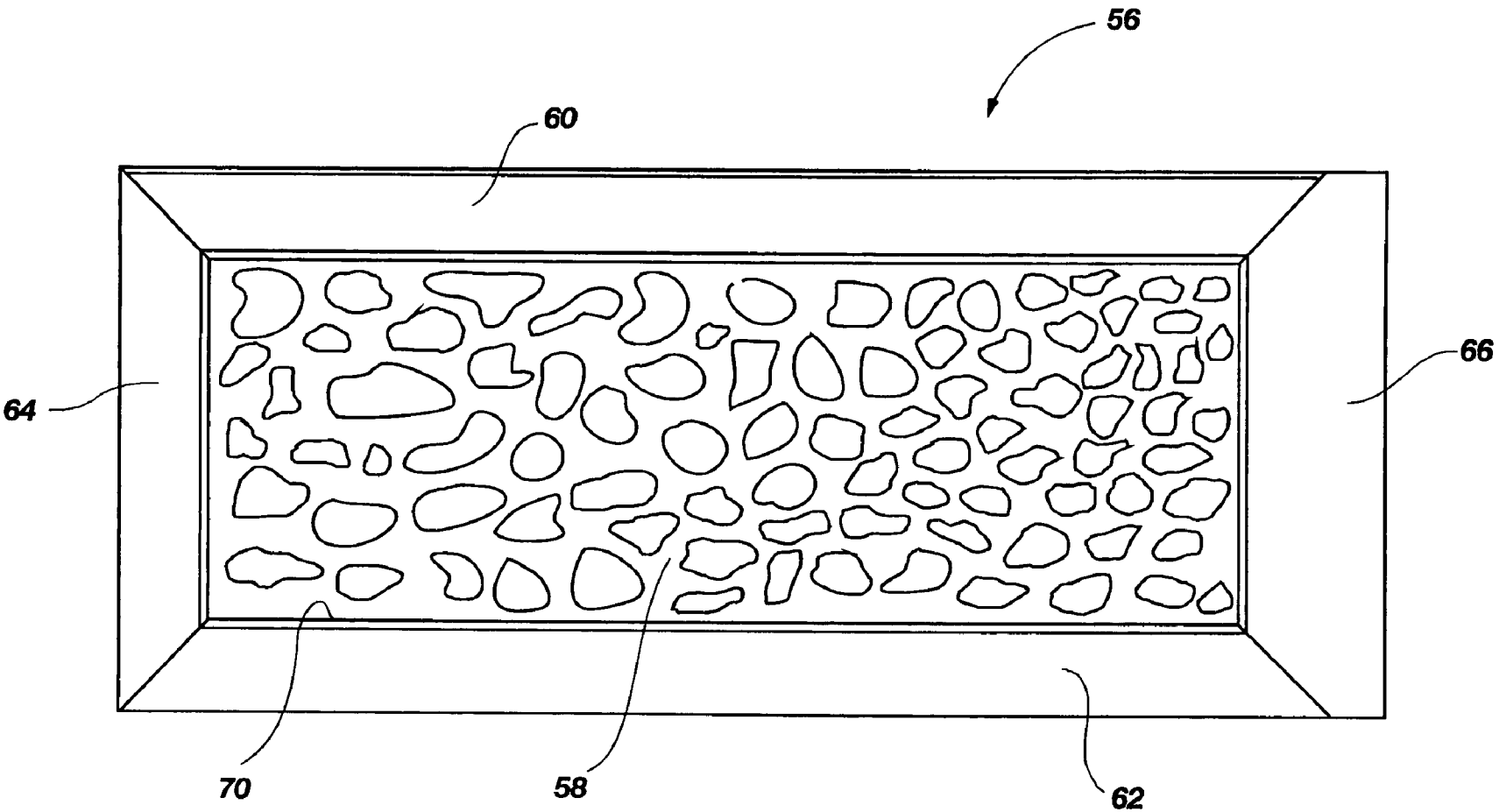
FIG. 9 is a side view of a panel useful with the partition of FIG. 8.
Figure 10:
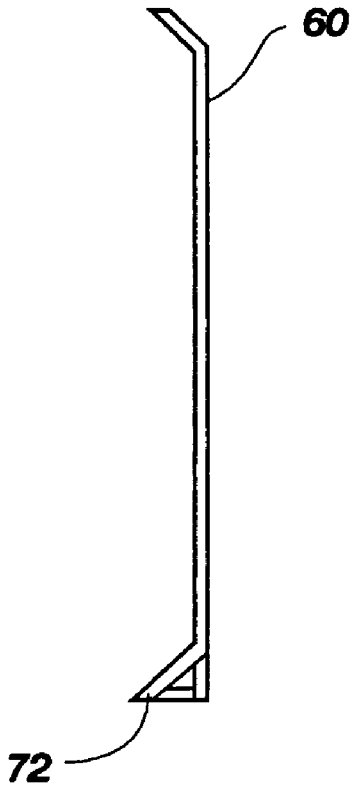
FIG. 10 is a side view of an upper member of the panel of FIG. 9.
Figure 11:
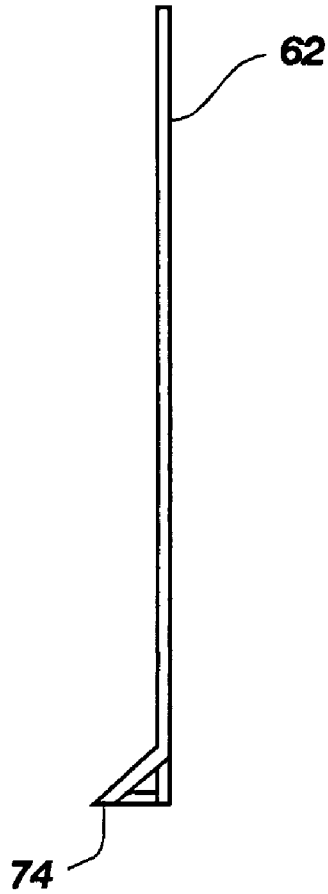
FIG. 11 is a side view of a lower member of the panel of FIG. 9.
Figure 12:
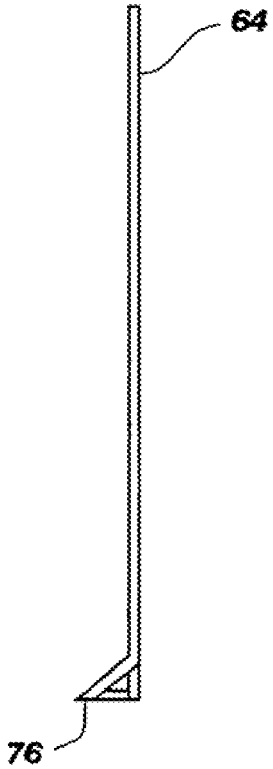
FIG. 12 is a side view of a first side member of the panel of FIG. 9.
Figure 13:
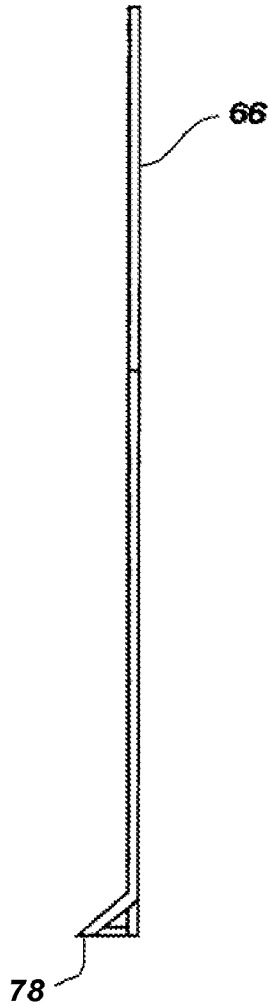
FIG. 13 is a side view of a second side member of the panel of FIG. 9.

A panel 56, as best shown in FIG. 9, may be positioned on an exterior surface of the partition 24. The panel 56 may include any variety of shapes or features desired to be applied to the concrete structures 10. One embodiment of the panel 56 may include a plate or liner 58 for placing a surface treatment 13 on the concrete structure 10. The surface treatment may include any variety of textures or designs, such as designs of rock or brick, for example. Other embodiments of the liner 58 may be substantially smooth, without any particular design. Moreover, some embodiments of the liner 58 may include a continuous pattern or texture configured to extend over the entire panel 56, whereas other embodiments of the liner 58 may have multiple patterns, or be configured to cover only a portion of the panel 56.

One embodiment of the panel 56 may include an upper member 60, a lower member 62, a first side member 64 and a second side member 66 for forming a frame or housing 70 around the liner 58 for holding the liner 58 in place. One embodiment of the upper member 60, lower member 62, first side member 64 and second side member 66 may be formed of plate steel, 3/16 inches thick, for example. However, it will be understood that various different materials having different dimensions may be used within the scope of the present disclosure to form the upper member 60, lower member 62, first side member 64 and second side member 66.

As shown most clearly in FIGS. 10-13, which depict side views of the upper member 60, lower member 62, first side member 64 and second side member 66, respectively, the housing 70 may be formed by an upper lip 72 on the upper member 60, a lower lip 74 on the lower member 62, a first side lip 76 on the first side member 64, and a second side lip 78 on the second side member 66. It will be understood that one embodiment of the upper lip 72, lower lip 74, first side lip 76 and second side lip 78 may be formed of a tri-angular shaped member. However, it will be understood that the housing 70 may be formed of various different shaped members configured to receive the liner 58. It will also be understood that some embodiments of the panel 56 may include a back wall behind the liner 58. Moreover, any variety of seals, adhesives, or attachment mechanisms may be used to maintain the liner 58 within the housing 70 and allow the liner 58 to be removed and interchanged with other liners for providing different surface treatments to the structures 10 to be formed. It will also be appreciated that other embodiments of the panel 56 may be formed without the upper member 60, lower member 62, first side member 64 and second side member 66, such that the panel 56 may be formed in different configurations without a frame or border surrounding the liner 58.

In use, panels 56 may be selected having a surface treatment desired to be placed on structures 10. The doors 48 may be opened and the partitions 24 may be moved to provide access to the partitions 24. The panels 56 may be joined with the partitions 24 and reinforcing steel may be placed in the apparatus for a particular structure 10, if desired. Adjacent partitions 24 may be moved to abut each other and reinforcing material may be placed in a subsequent cavity 26. Once all of the reinforcing material is placed in the apparatus and the partitions 24 are joined together, the partitions 24 may be fastened in place using fasteners 68, as best shown in FIG. 3. One embodiment of the fasteners 68 may include pins receivable in the base 23 for holding the partitions 24 in place. It will also be understood that the fasteners 68 may include any other variety of fastening mechanism known in the art, including threaded rods having adjustable blocking members attached thereto. The rods may be pivotally attached to the base 23 or the partitions 24 and the blocking members may be engaged with the other of the base 23 or the partitions 24 for adjustably blocking movement of the partitions 24. Moreover, it will be understood that additional fasteners 69, as shown in dashed lines in FIGS. 3 and 5, may be used to fasten the partitions 24 in place. The additional fasteners 69 may include bolts extending through the exterior partition 24 on opposing ends of the apparatus 20. It will be understood that the location, configuration and quantity of fasteners 68 or additional fasteners 69 may vary within the scope of the present disclosure. Moreover, it will be understood that any other type of bolt, latch, pin, clamp or fastener known in the art may be used to hold the partitions 24 in place within the scope of the present disclosure.

Wet concrete may then be poured into the top of the apparatus 20 from above to thereby fill the cavities 26. Once the concrete has hardened adequately, the partitions 24 may be separated and the structures 10 may be removed. It will be understood that any variety of lifting mechanisms, such as cranes or lifts, may be used to remove the structures from the apparatus 20. Moreover, in some uses of the apparatus 20, it may be beneficial to apply a suitable anti-sticking agent to the apparatus 20 prior to placing concrete in the apparatus 20 to facilitate removing the structure 10 from the apparatus 20. Once the structures are removed from the apparatus 20, the apparatus may be cleaned and used repeatedly to produce additional structures 10 in a controlled environment for shipping to a construction site for installation. The apparatus 20 may also be placed in any location as desired to facilitate construction or shipping of the structures 10.

It will be understood that some embodiments of the present disclosure may include an apparatus that may be configured to form a plurality of structures that do not include the column portions, such that a plurality of panels may be formed. Other embodiments of the present disclosure may include an apparatus that forms structures in the form of columns. Accordingly, any variety of structures, having different arrangements of columns and/or panels, may be formed in accordance with the principles of the present disclosure. Moreover, other structures of various different configurations may be formed that may not be considered to be either panels or columns, in accordance with the principles of the present disclosure.

It will be appreciated that the apparatus 20 may be configured to receive concrete of various different varieties known in the art. Moreover, the apparatus 20 may accommodate reinforcing material or steel, commonly referred to as rebar, to construct structures 10 of various different designs and configurations. The arrangement of the cavity 26 may allow for reinforcing steel to be place continuously in the first portion 28 of the cavity 26 for forming the panel portion 12 of the structure 10 and the second portion 30 of the cavity for forming the column portion 14 of the structure 10, such that the panel portion 12 and the column portion 14 of the structure 10 can be tied together with the reinforcing steel. It will also be understood that the apparatus 20 may also include any variety of vibrating mechanisms integrally or removably attached to the apparatus 20 in various different configurations to facilitate dispersal of wet concrete within the cavities 26.

It will be understood that the apparatus 20 may be formed of any suitable materials known in the art. For example, portions of the apparatus 20 may be formed of steel, and components of the apparatus 20 may be joined together using any suitable method known in the art, such as by welding or bolting, for example. The liner 58 may be formed of any suitable material for placing a texture or design on the concrete without bonding to the concrete such that the structures 10 may be removed from the apparatus 20 without damage.

In accordance with the features and combinations described above, a useful method of forming concrete structures may include the steps of:

(a) placing a plurality of partitions in a side by side arrangement;

(b) defining a plurality of cavities with the plurality of partitions, the plurality of cavities each having a column portion and a panel portion such that the concrete structures include a one piece column and panel. The method may also include selecting liners having a desired surface treatment to be placed on the structures and removably attaching the liners to the partitions.

Those having ordinary skill in the relevant art will appreciate the advantages provided by the features of the present disclosure. For example, it is a feature of the present disclosure to provide an apparatus for forming one or more concrete structures which is simple in design and manufacture. Another feature of the present disclosure is to provide such an apparatus capable of forming concrete structures having walls with integral columns. It is a further feature of the present disclosure, in accordance with one aspect thereof, to provide an apparatus for forming one or more concrete structures in which the apparatus may include interchangeable liners for placing different surface treatments, textures or finishes on the structures. It is an additional feature of the present disclosure to provide an apparatus for forming one or more concrete structures, in which the structures may be efficiently produced and installed. It is an additional feature of the present disclosure to provide an apparatus for forming precast concrete structures in which the structures may be formed in a factory setting with controlled conditions for improved quality of the structures.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An apparatus for simultaneously forming a plurality of concrete structures, said apparatus comprising:

a frame;

a plurality of partitions mounted on said frame, said plurality of partitions comprising at least three partitions being positioned in a side by side arrangement to form a plurality of cavities, each of said plurality of cavities being separated by a corresponding one of said plurality of partitions, each of said cavities defining:

a first portion for receiving wet concrete for forming a panel portion of one of said concrete structures, said panel portion having a first end and an opposing second end, and a second wider portion communicating with said first portion for receiving wet concrete for forming a column portion on said second end of said panel portion, said column portion having a slot formed therein, said first end of said panel portion being sized so that it can be received within said slot; and an end wall mounted on said frame and being disposed adjacent to an end of said plurality of partitions, said end wall being independently moveable relative to said plurality of partitions and relative to said frame, said plurality of partitions being moveable in a first direction, and said end wall being moveable in a second direction substantially perpendicular with respect to said first direction.

2. The apparatus of claim 1, further comprising at least one rib for positioning in at least one of said second portions for forming said slot in said column portion of said concrete structure.

3. The apparatus of claim 1, wherein at least one of said plurality of partitions comprises a liner for applying a surface treatment to said concrete structures.

4. The apparatus of claim 3, wherein said liner is removably attachable to said at least one of said plurality of partitions such that said liner is interchangeable to form concrete structures having different surface treatments.

5. The apparatus of claim 1, wherein said first portion of said cavity and said second portion of said cavity are contiguous such that said panel portion and said column portion are configured to be formed as a single piece.

6. The apparatus of claim 1, wherein at least one of said plurality of partitions is supported by wheels resting on the frame to facilitate moving said at least one of said partitions on the frame.

7. The apparatus of claim 1, wherein said frame comprises an overhang for supporting said plurality of partitions when said plurality of partitions are separated.

8. An apparatus for simultaneously forming a plurality of concrete structures, said apparatus comprising:

a frame;

a plurality of partitions mounted on said frame and having a first end and an opposing second end, said plurality of partitions comprising at least three partitions being positioned in a side by side arrangement to form a plurality of cavities, each of said plurality of cavities being separated by a corresponding one of said plurality of partitions, each of said cavities defining:

a first portion for receiving wet concrete for forming a panel portion of a concrete structure, and a second portion in communication with the first portion for receiving wet concrete for forming a column portion on said panel portion;

a first end wall mounted on said frame adjacent to said first end of said plurality of partitions so as to bound a portion of said plurality of cavities; and a plurality of first ribs mounted on said first end wall, wherein each of said plurality of first ribs is positioned in a separate one of said second portions for defining slot extending along the length of said column portion of said concrete structures;

wherein at least one of said plurality of partitions is moveable with respect to said frame and with respect to said first end wall and wherein said first end wall is moveable with respect to said frame in a direction substantially perpendicular to a direction of movement of said at least one of said plurality of partitions.

9. The apparatus of claim 8, wherein said second portion of said cavity for forming a column portion is wider than said first portion of said cavity for forming said panel portion.

10. The apparatus of claim 8, wherein said plurality of first ribs are removably positioned such that said cavity can be configured to form said column portion of said concrete structure with said slot in different locations.

11. The apparatus of claim 10, wherein said plurality of first ribs are bolted to said first end wall.

12. The apparatus of claim 8, wherein at least one of said plurality of partitions comprises a liner for applying a surface treatment to one of said concrete structures.

13. The apparatus of claim 12, wherein said liner is removably attachable to said at least one of said plurality of partitions such that said liner is interchangeable to form concrete structures having different surface treatments.

14. An apparatus for forming a plurality of concrete structures, said apparatus comprising:

a frame;

a plurality of partitions movably mounted to said frame, each of said plurality of partitions having a first side and an opposing second side that each extend between a first end and an opposing second end, said plurality of partitions comprising at least three partitions and being positionable in a side by side arrangement to form a plurality of cavities therebetween for receiving concrete for forming said concrete structures; and a first end wall movably mounted to said frame and disposed adjacent to said first end of said plurality of partitions so as to partially bound said plurality of cavities, said first end wall being moveable in a direction away from said partitions, wherein said partitions are moveable in a first direction, and said first end wall is moveable in a second direction substantially perpendicular with respect to said first direction.

15. The apparatus of claim 14, wherein said first end wall is moveable in a translational manner.

16. The apparatus of claim 14, further comprising wheels for supporting said first end wall on said frame and facilitating movement of said first end wall relative to said frame.

17. The apparatus of claim 14, wherein said plurality of cavities each define:

a first portion for receiving wet concrete for forming a panel portion of one of said concrete structures, and a second wider portion for receiving wet concrete for forming a column portion of one of said concrete structures.

18. The apparatus of claim 17, further comprising at least one rib mounted on said first end wall for positioning in at least one of said second portions for forming a slot in said column portion of said structure.

19. The apparatus of claim 14, wherein at least one of said plurality of partitions comprises a liner for applying a surface treatment to one of said concrete structures.

20. The apparatus of claim 19, wherein said liner is removably attachable to said at least one of said plurality of partitions such that said liner is interchangeable to form concrete structures having different surface treatments.

21. The apparatus of claim 1, wherein said plurality of partitions each comprise at least one brace member for providing strength to said plurality of partitions.

22. The apparatus of claim 3, wherein said plurality of partitions each comprise a panel having an upper member, a lower member, a first side member and a second side member, and wherein said liner is removably attachable to said panel.

23. The apparatus of claim 1, wherein said plurality of partitions each comprise end panels on opposing ends of said partitions.

24. The apparatus of claim 1, further comprising means for removably fastening said plurality of partitions in a position.

25. The apparatus of claim 1, wherein one of the plurality of partitions comprises a first side that at least partially forms one of the plurality of cavities and an opposing second side that at least partially forms a separate one of the plurality of cavities.

26. The apparatus of claim 1, wherein the plurality of partitions are arranged so as to be substantially parallel to one another in separate planes and wherein each of the plurality of partitions are independently movable relative to the frame and remain in the substantially parallel planes when they are moved on said frame.

27. The apparatus of claim 26, wherein at least one of said plurality of partitions is movable with respect to the other partitions.

28. An apparatus for simultaneously forming a plurality of concrete structures, said apparatus comprising:

a frame;

a plurality of partitions mounted on said frame, said plurality of partitions comprising at least three partitions being positioned in a side by side arrangement to form a plurality of cavities, each of said plurality of cavities being separated by a corresponding one of said plurality of partitions, each of said cavities defining:

a first portion for receiving wet concrete for forming a panel portion of one of said concrete structures, and a second wider portion communicating with said first portion for receiving wet concrete for forming a column portion on said panel portion;

wherein the plurality of partitions are arranged so as to be substantially parallel to one another in separate planes and wherein each of the plurality of partitions are independently movable relative to the frame and remain in the substantially parallel planes when they are moved on said frame;

wherein each of said plurality of partitions is movable with respect to the other partitions in a direction substantially orthogonal to the plane of the partition.

29. The apparatus of claim 14, further comprising a hinge positioned so that the end wall can engage the hinge and swing open after the end wall has been moved away from said partitions.

30. The apparatus of claim 1, wherein each partition has a first end and an opposing second end, a wheel supporting each end of each partition on said frame and facilitating movement of each partition relative to said frame.

31. The apparatus of claim 1, wherein the entirety of each partition is movable relative to said frame and relative to the other partitions.

32. The apparatus of claim 8, wherein the entirety of each partition is movable relative to said frame and relative to the other partitions.

33. The apparatus of claim 8, wherein said first end wall is movably mounted on the frame so that the entire first end wall can independently move relative to said frame and said plurality of partitions.

34. The apparatus of claim 8, further comprising a second end wall movably mounted on said frame adjacent to said second end of said plurality of partitions.

35. The apparatus of claim 34, further comprising a plurality of second ribs mounted on said second end wall, wherein each of said plurality of second ribs is positioned in a separate one of said second portions for defining a slot in said column portion of said concrete structures.

36. The apparatus of claim 14, further comprising wheels supporting said plurality of partitions and said first end wall on said frame so that each of said plurality of partitions and said first end wall can move relative to said frame.

37. The apparatus of claim 14, further comprising a second end wall movably mounted on said frame adjacent to said second end of said plurality of partitions.

38. An apparatus for simultaneously forming a plurality of concrete structures, said apparatus comprising:

a frame;

a plurality of partitions mounted on said frame and having a first end and an opposing second end, said plurality of partitions comprising at least three partitions being positioned in a side by side arrangement to form a plurality of cavities, each of said plurality of cavities being separated by a corresponding one of said plurality of partitions, each of said cavities defining:

a first portion for receiving wet concrete for forming a panel portion of a concrete structure, and a second portion in communication with the first portion for receiving wet concrete for forming a column portion on said panel portion;

a first end wall mounted on said frame adjacent to said first end of said plurality of partitions;

a second end wall mounted on said frame adjacent to said first end of said plurality of partitions; and a plurality of first ribs mounted on said first end wall, wherein each of said plurality of first ribs is positioned in a separate one of said second portions for defining a slot in said column portions;

a plurality of second ribs mounted on said second end wall, wherein each of said plurality of first ribs is positioned in a separate one of said second portions for defining a slot in said column portions; and wheels supporting said plurality of partitions and said first and second walls on said frame so that each of said plurality of partitions and said first and second end walls can move relative to said frame.

* * * * *

UNITED STATES PATENT AND TRADEMARK OFFICE

CERTIFICATE OF CORRECTION

PATENT NO. : 7,665,712 B2
APPLICATION NO. : 11/232289
DATED : February 23, 2010
INVENTOR(S) : Stott It is certified that error appears in the above-identified patent and that said Letters Patent is hereby corrected as shown below:

Title Page, illustrating a Figure should be deleted and replaced with a new Title Page illustrating a Figure (attached)

Drawings
Sheet 2, replace FIG. 2 with the figure depicted below, wherein the "base" has been labeled at --23--

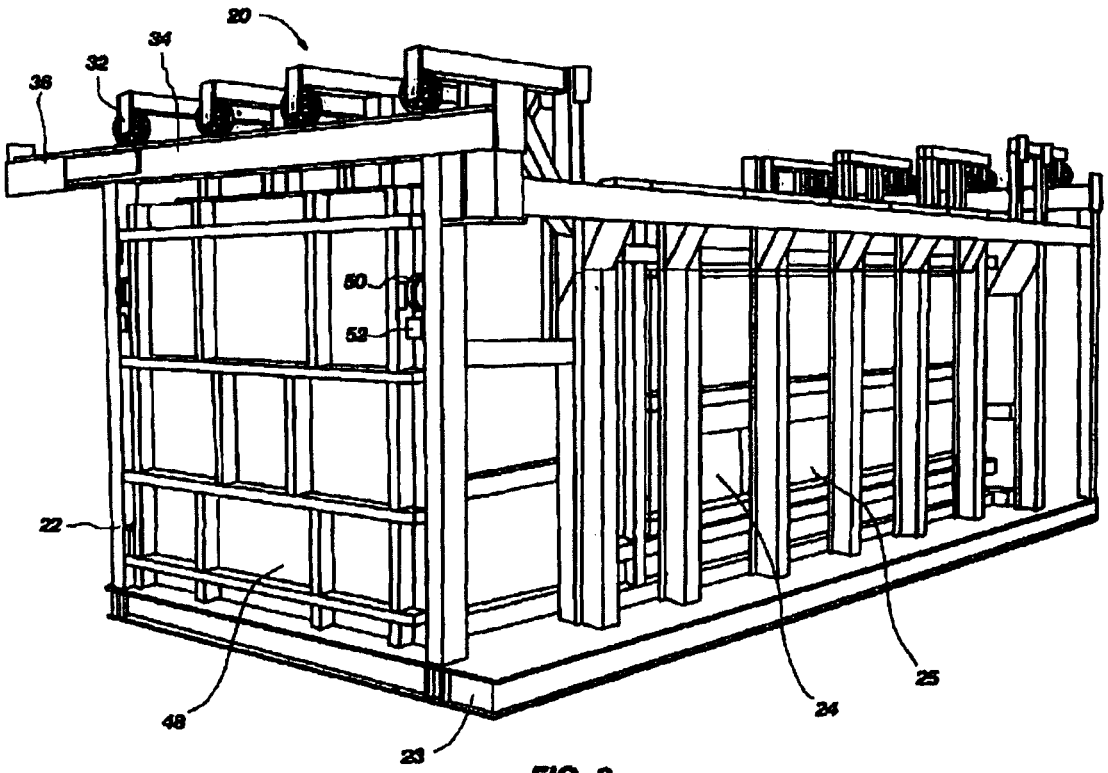

FIG. 2

Signed and Sealed this

Thirteenth Day of July, 2010

David J. Kappos

David J. Kappos
*Director of the United States Patent and Trademark Office*

Column 6
Line 39, change “are-in” to --are in--

Column 7
Line 32, change “tri-angular” to --triangular--

Column 8
Line 3, change “24” to --25--
Line 45, change “place” to --placed--

Column 9
Line 30, change “Detailed Description” to --detailed description--
Line 39, change “Detailed Description” to --detailed description--

Column 10
Line 61, change “slot” to --a slot--

(12) United States Patent
Stott

(10) Patent No.: US 7,665,712 B2
(45) Date of Patent: Feb. 23, 2010

(54) APPARATUS FOR PRE-CASTING CONCRETE STRUCTURES

(75) Inventor: Gale J. Stott, Salt Lake City, UT (US)

(73) Assignee: Intellectual Property Management, LLC, Salt Lake City, UT (US)

( * ) Notice: Subject to any disclaimer, the term of this patent is extended or adjusted under 35 U.S.C. 154(b) by 334 days.

(21) Appl. No.: 11/232,289

(22) Filed: Sep. 20, 2005

(65) Prior Publication Data

US 2006/0174569 A1 Aug. 10, 2006

Related U.S. Application Data

(60) Provisional application No. 60/622,855, filed on Oct. 27, 2004.

(51) Int. Cl.
*B28B 7/24* (2006.01)
*B28B 7/36* (2006.01)
*E04B 2/00* (2006.01)

(52) U.S. Cl. ..... 249/162; 249/85; 249/112; 249/119; 249/128; 249/160; 249/189

(58) Field of Classification Search ..... 249/85, 249/112–115, 134, 157, 165, 189, 216, 117, 249/119, 120, 125–130, 160–162, 169–171, 249/187.1, 191, 155, 158; 52/426, 436; 425/338

See application file for complete search history.

(56) References Cited

U.S. PATENT DOCUMENTS 1,247,107 A 11/1917 Graham
1,276,264 A * 8/1918 Porter et al. ..... 249/13
1,712,678 A * 5/1929 Redman ..... 249/16
1,754,087 A * 4/1930 Flam ..... 249/129
1,937,306 A * 11/1933 Barriball ..... 249/16
2,185,335 A * 1/1940 Fischer ..... 52/426
2,474,654 A * 6/1949 Carlson ..... 264/226
2,651,391 A * 9/1953 Havens ..... 52/11
2,981,997 A 5/1961 Painter
3,260,494 A 7/1966 Deiggaard
3,360,231 A * 12/1967 Van Hezik ..... 249/129
3,381,929 A * 5/1968 Bancker ..... 249/5
3,481,093 A * 12/1969 Davidson ..... 52/293.1
3,507,084 A * 4/1970 Jay et al. ..... 52/601
3,635,642 A 1/1972 Mueller (Continued)

FOREIGN PATENT DOCUMENTS

GB 2241192 A * 8/1991

(Continued)

*Primary Examiner*—Philip C Tucker
*Assistant Examiner*—Dimple N Bodawala
(74) *Attorney, Agent, or Firm*—Workman Nydegger

(57) ABSTRACT

An apparatus for producing one or more pre-cast concrete structures. The apparatus may include partitions that may be positioned in a side by side arrangement. The partitions may be moveable with respect to each other to facilitate installation of reinforcing material and removal of the concrete structures from the apparatus after the concrete has hardened. Cavities may be defined by the partitions for receiving concrete to form structures having panels with integral columns. The columns may include slots for receiving an adjacent panel such that adjacent concrete structures may be joined together to form a continuous wall. The partitions may also include interchangeable liners such that different textures or finishes may be applied to the concrete structures.

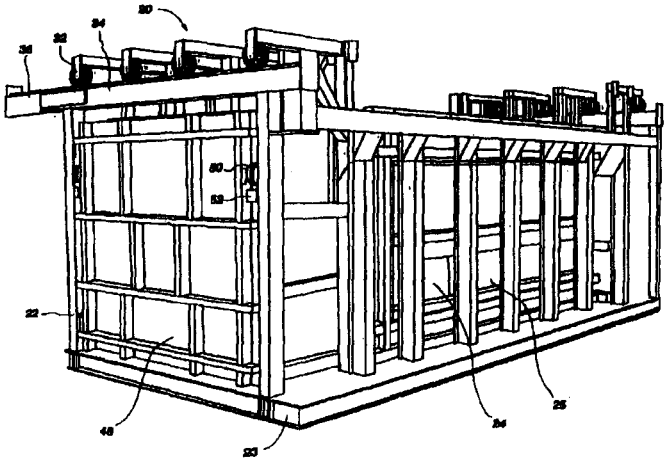

38 Claims, 10 Drawing Sheets